United States Patent [19]

Orr

[11] 4,274,618

[45] Jun. 23, 1981

[54] STRAND LIFTING SYSTEM

[76] Inventor: James A. Orr, 1570 Guadalajara Dr., San Jose, Calif. 95120

[21] Appl. No.: 68,146

[22] Filed: Aug. 20, 1979

[51] Int. Cl.[3] ..... F21B 19/00

[52] U.S. Cl. ..... 254/29 A

[58] Field of Search ..... 254/29 A; 29/452; 52/223 R, 223 L, 225, 230

[56] References Cited

U.S. PATENT DOCUMENTS

| | | | |
|---|---|---|---|
| 3,491,431 | 1/1970 | Pewitt | 254/29 A |
| 3,658,296 | 4/1972 | Yegge | 254/29 A |
| 3,844,023 | 10/1974 | Surribas | 254/29 A |

*Primary Examiner*—Robert C. Watson

*Attorney, Agent, or Firm*—Allston L. Jones; David A. Boone

[57] ABSTRACT

Steel strand is passed through a plurality of upper and lower multi-part chucks which each are capable of grasping and holding steel strand passed through it when they are seated in upper and lower seating chambers, respectively. Upper and lower hydraulic seating rams comprise pistons used to cause chuck seating plates to be driven against the top flanges of the upper and lower chucks, thereby causing them to seat within their respective seating chambers. Either or both the top and bottom chucks may be seated at the same time. A hydraulic system allows an operator to smoothly lift and lower loads through the seating and unseating of the upper and lower chucks and the extending and retracting of pistons of main lifting rams interposed between plates containing the upper and lower chuck seating chambers.

6 Claims, 6 Drawing Figures

STRAND LIFTING SYSTEM

BACKGROUND AND SUMMARY

Various hydraulic systems have been used for post tensioning or to lift heavy loads such as preformed concrete walls, etc. Many of these types of systems have used steel strand which passed through chucks. For example, see U.S. Pat. No. 3,658,296 issued Apr. 25, 1972 in the name of Lawrence R. Yegge; No. 3,837,621 issued Sept. 24, 1974 in the name of Juan Bautista Ripoll Gomez; No. 2,833,118 issued May 6, 1958 in the name of L. Nixon; and No. 4,106,752 issued Aug. 15, 1978 in the name of Eduardo Caro Roqueta.

Generally, these previous systems have had the disadvantage that they were designed for post tensioning concrete reinforcement members, not for heavy lifting and lowering of a load. It was very difficult to lift and lower a load any substantial distance since there was no easy way to engage and disengage the sets of chucks.

In accordance with the preferred embodiment of the present invention, a plurality of steel strands are passed through upper and lower sets of chucks which each comprise a plurality of jaws held together by a compression spring which biases the chuck assembly in a disengaged position from a chuck chamber. The chuck chambers are threaded members which are screwed into upper and lower plates. A seating ram is used to seat the chucks within the chuck chamber whenever it is desired to grasp and hold the steel strand passing through them. Items are lifted by seating the upper chucks and then extending the pistons of the rams to effect the lifting operation. Once the pistons are fully extended, further lifting is accomplished by seating the lower chucks, releasing the upper chucks and bringing the pistons back to their original position. The upper chucks are then reseated and the pistons of the rams are extended. This procedure is repeated until the load is moved the desired distance. Relief space about the chucks, an angular slope to their top flange, combined with their multiple part construction enhance their releasability from the chuck chambers and minimize drag on the steel strand when the chucks are not seated and the strand is pulled through in either direction. A hydraulic system ensures the smooth lifting or lowering of the load.

BRIEF DESCRIPTION OF THE DRAWING

FIG. 3A shows the chuck in engaged position while FIG. 3B shows the chuck in the disengaged position

DESCRIPTION OF THE PREFERRED EMBODIMENT

Figures 1, 2:
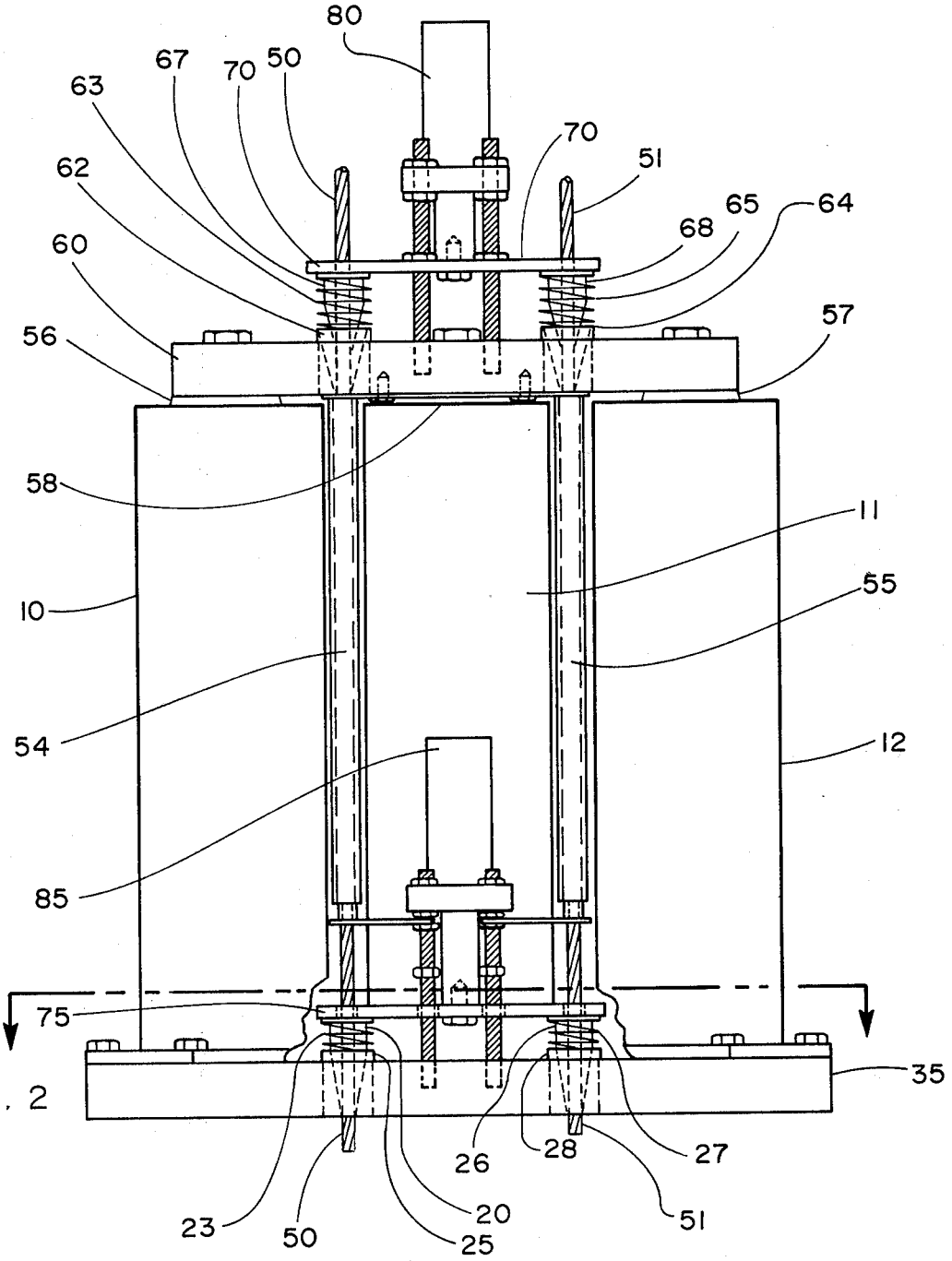
FIG. 1 is a front view of the strand lifting system of the preferred embodiment.
FIG. 2 is a top sectional view of the strand lifting system of the peferred embodiment.
Figure 2:
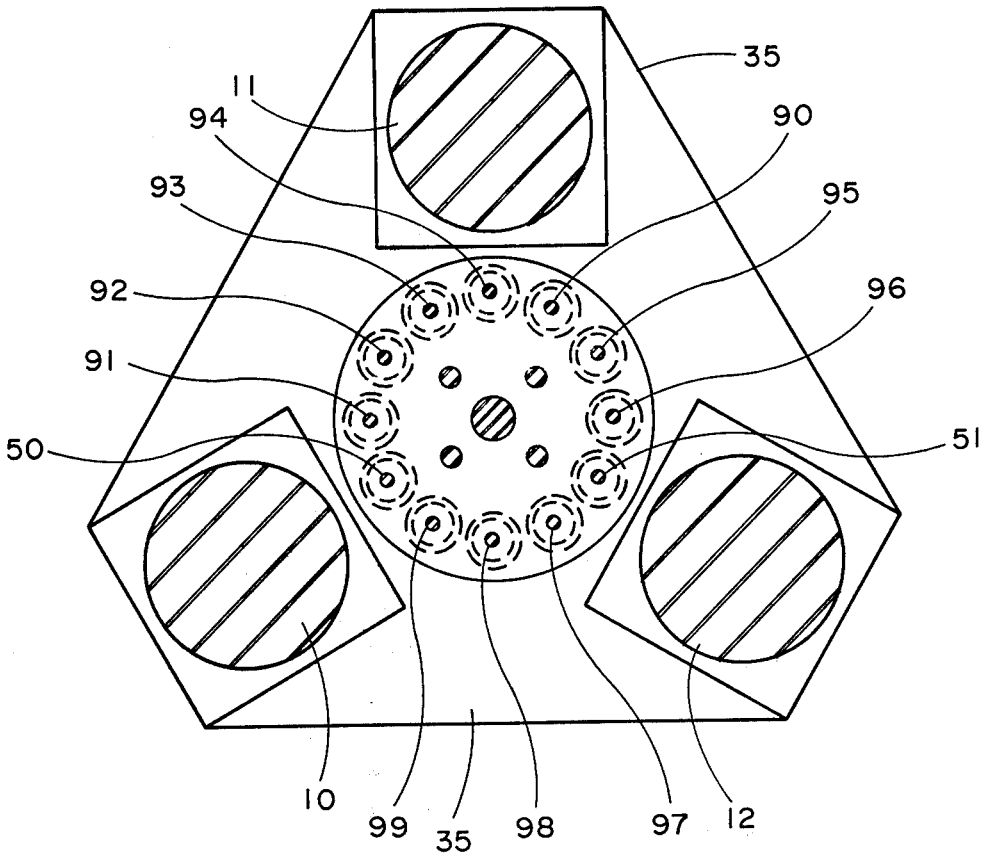

Referring now to FIG. 1, there is shown a front view of the strand lifting system of the preferred embodiment. Hydraulic rams 10, 11 and 12 are arranged in a triangular configuration between top plate 60 and bottom plate 35.

In the preferred embodiment, the bases of the hydraulic rams are attached to the base plate 35 while the pistons of the rams, e.g. pistons 56, 57 and 58, are attached to the top plate 60.

Bearing plates 35 and 60 have patterns of holes which are identical and which are aligned with each other. Into these holes are fitted chuck chambers 25, 28, 62 and 64, into which chucks 20, 26, 67 and 68 may be engaged and disengaged. Chucks 20, 26, 67 and 68 are of multipiece jaw construction. The jaws are loosely held together and biased toward a disengaged position from their respecting chuck chambers by springs 23, 27, 63 and 65. Steel strand 50 is passed through a seating plate 70, chuck 67, chuck chamber 62, a strand guard 54, seating plate 75, chuck 20, chuck chamber 25, and bottom plate 35. Similarly, steel strand 51 passes through seating plate 70, chuck 68, chuck chamber 64, strand guard 55, seating plate 75, chuck 26, chuck chamber 28, and bottom plate 35. The steel strand is used for lifting or lowering items attached to the ends of the strand which extend below the base plate.

To grasp the strand and lift an item, it is necessary to seat the upper chucks 67 and 68 within chuck chambers 62 and 64. This is done by using seating ram 80 to cause chuck seating plate 70 to seat the chucks 67 and 68 within chuck chambers 62 and 64. Once the chucks are seated, lifting rams 10, 11 and 12 can be activated to extend their pistons and lift top plate 60, thereby pulling steel strand 50 and 51 which are gripped by the securely seated chucks 67 and 68.

Once the pistons of lifting rams 10, 11 and 12 are fully extended, further movement requires the following sequence of operations. Lower chucks 20 and 26 must be seated by using seating ram 85 to cause seating plate 75 to drive chucks 20 and 26 into chuck chambers 25 and 28, respectively. Once this is accomplished, the strand and, therefore, the load is being held securely by these lower chucks. Therefore, the lifting rams 10, 11 and 12 may be returned to their original compressed position. The stiffness of steel strand 50 and 51 combined with the downward movement of the lifting ram pistons forces the upper chucks 67 and 68 out of chuck chambers 62 and 64 whereupon they are held out by compression springs 63 and 65. When the pistons are fully retracted, the lifting of the item or load beneath lower plate 35 may be continued by reseating chucks 67 and 68 and once again extending pistons 56, 57 and 58 of rams 10, 11 and 12. Note that when the pistons are once again extended, the chucks 20 and 26 will be unseated by the movement of the strand upwards and they will remain disengaged through the action of compression springs 23 and 27. An item or load can be lifted or moved any distance by repeating the above steps.

For lowering an item, the sequence of the above operations is basically reversed, with some minor differences. The exact procedure is discussed in detail with respect to the hydraulic schematic of FIG. 5

Referring now to FIG. 2, there is shown a cross-sectional view of a system as shown in FIG. 1. Note that while only two strands and their related chuck assemblies were discussed with respect to FIG. 1, for purposes of clarity, a system may actually comprise a twelve strand lifting system as shown in the cross-sectional view of FIG. 2. Steel strands 50, 51, 91, 92, 93, 94, 90, 95, 96, 97, 98 and 99 would all be used simultaneously to lift the load. By using a plurality of chucks and steel strand, the danger from any undetected weakness in one or two steel strands causing injury if the load should be dropped because one or two of the steel strands should suddenly break is minimized.

Referring now to FIG. 3, there is shown a detail of the chuck assembly used in the preferred embodiment. In the preferred embodiment, multi-piece chuck 67 comprises three separate pieces or jaws. A two-piece chuck could be used but is undesirable because the stress concentrations in these extreme loads would result in cracking. Chuck chamber 62 is slightly relieved at points 106 and is screwed into and held in plate 60 by threads along the mating area 107 between the two pieces. The relief is provided so that all the weight is supported by the threads. Also, the inside surface of the jaws which comprise chuck 67 are provided with teeth to enhance the gripping action between them and the steel strand.

Figure 4:
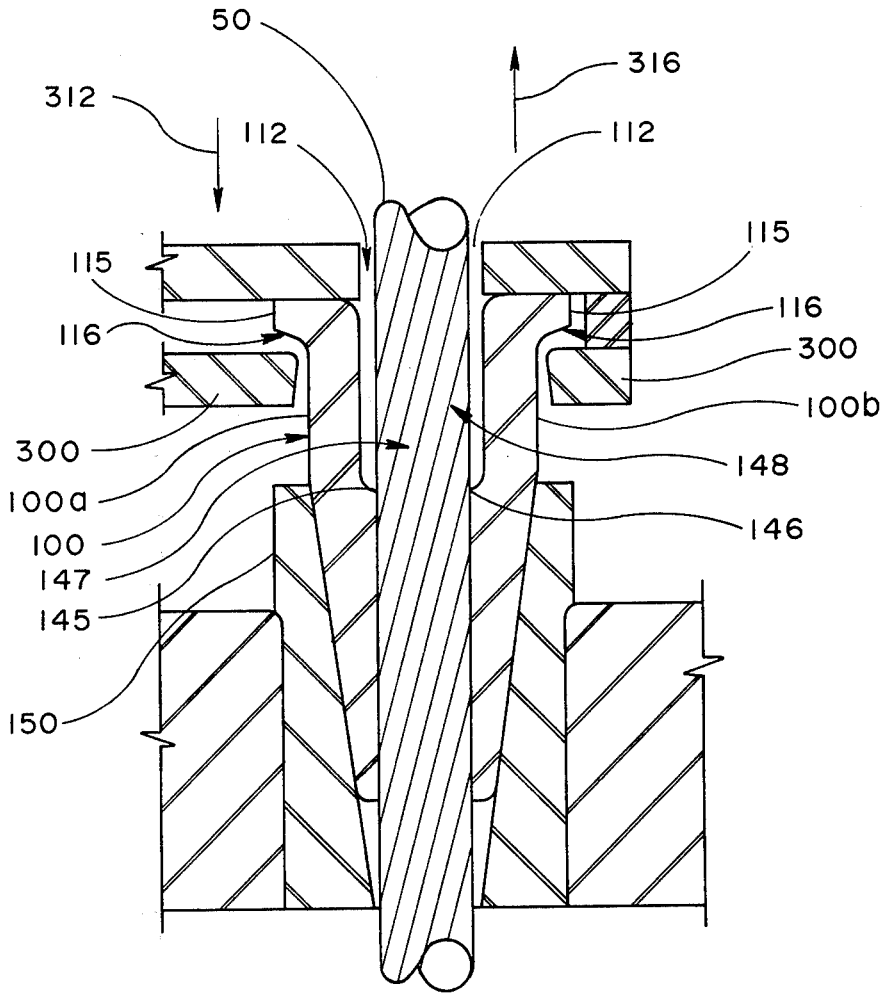
FIG. 4 is a sectional side view of an alternate chuck chamber assembly utilizing hydraulic unseating of the chucks for use with the preferred embodiment.

Referring now to FIG. 4, there is shown a cross-sectional view of an alternate embodiment of a chuck for use in the preferred embodiment. Multi-part chuck 100 is shown in the seated position within chuck chamber 150. Steel strand cable 50 is passing through and being gripped by chuck 100. Seating ram 300 is in contact with the top surface of flange 115 and is in the position to engage upper flange 115. Movement of seating ram 300 in the direction shown by arrow 312 acts to seat chuck 100 within chuck chamber 150. Similarly, movement of seating ram 300 in the direction shown by arrow 316 acts to unseat chuck 100 from chuck chamber 150.

Figure 3A:
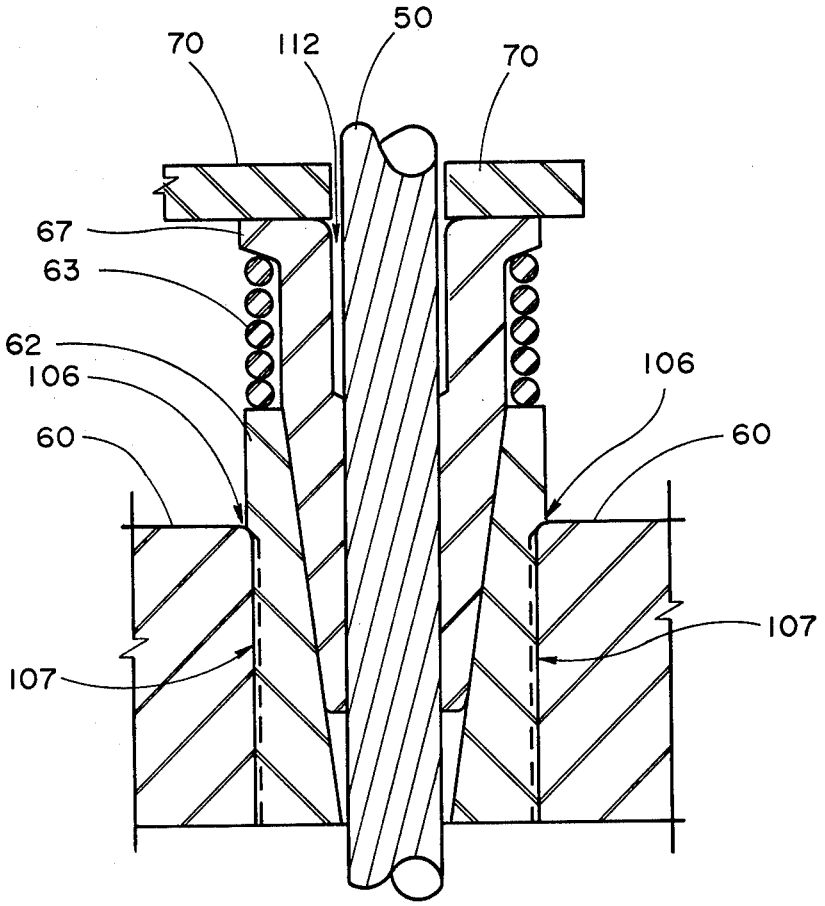
FIGS. 3A and 3B are sectional side views of a chuck assembly for use with the preferred embodiment.
Figure 3B:
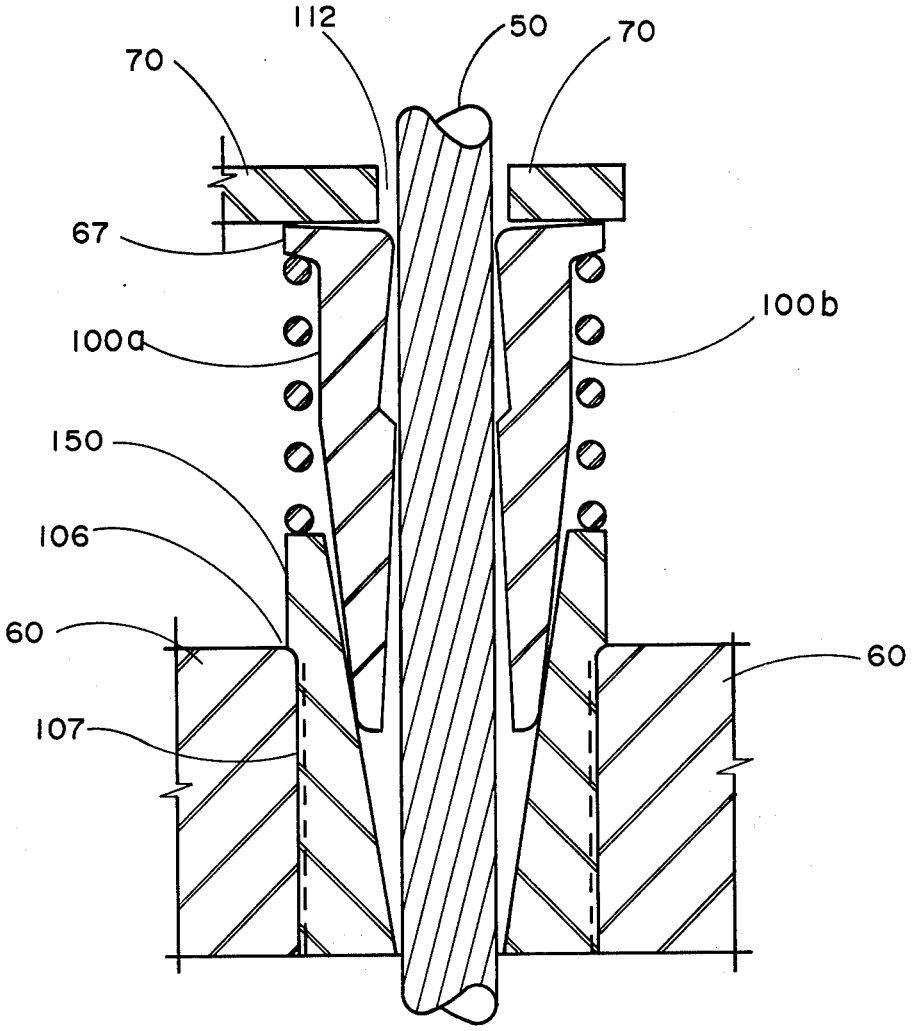

Note that for the chuck assemblies of FIGS. 3 and 4 there is a relief 112 formed by the upper portion of the plurality of jaws, that is, the top portion of the jaw pieces forming chuck 100 have a larger internal diameter than the lower portion. Also, the lower edges of top flange 67 in the embodiment of FIG. 3A and 3B and top flange 115 in the embodiment of FIG. 4 slope inward at approximately ten degrees from the horizontal. In the embodiment of FIG. 4, when seating ram 300 is driven in the direction indicated by arrow 316, the slope of surface 116 of flange 115 combined with the relief gap 112 not only causes the chuck 100 to unseat from chuck chambers 150 but also causes the chuck jaw pieces to pivot or swivel about the relief point areas, e.g. 145 and 146, in the inward direction as indicated by arrows 147 and 148, thereby causing the jaw pieces **100*a* and 100*b* of chuck 100 to disengage from steel strand 50. In the embodiment of FIGS. 3A and 3B, spring 63 rides along the sloped lower edge of flange 67** and causes the pivoting about the relief area which keeps the jaws from dropping on the steel strand as it is pulled through the chuck. This swiveling is illustrated in FIG. 3B. This is quite important since the extreme pressures involved in the intended applications of the preferred embodiment will cause some amount of molding and deformation during the lifting operations. This tends to make the jaw pieces resist disengaging from the steel strand, thus interfering with the alternate releasing and engaging of the top and bottom chucks as described above. This swivel effect also helps to keep the gripping teeth of the chuck from picking up steel strand unnecessarily. When the chuck is disengaged from the chuck chamber, the jaws also will swivel away from the steel strand as it is pulled in either direction through them.

Figure 5:
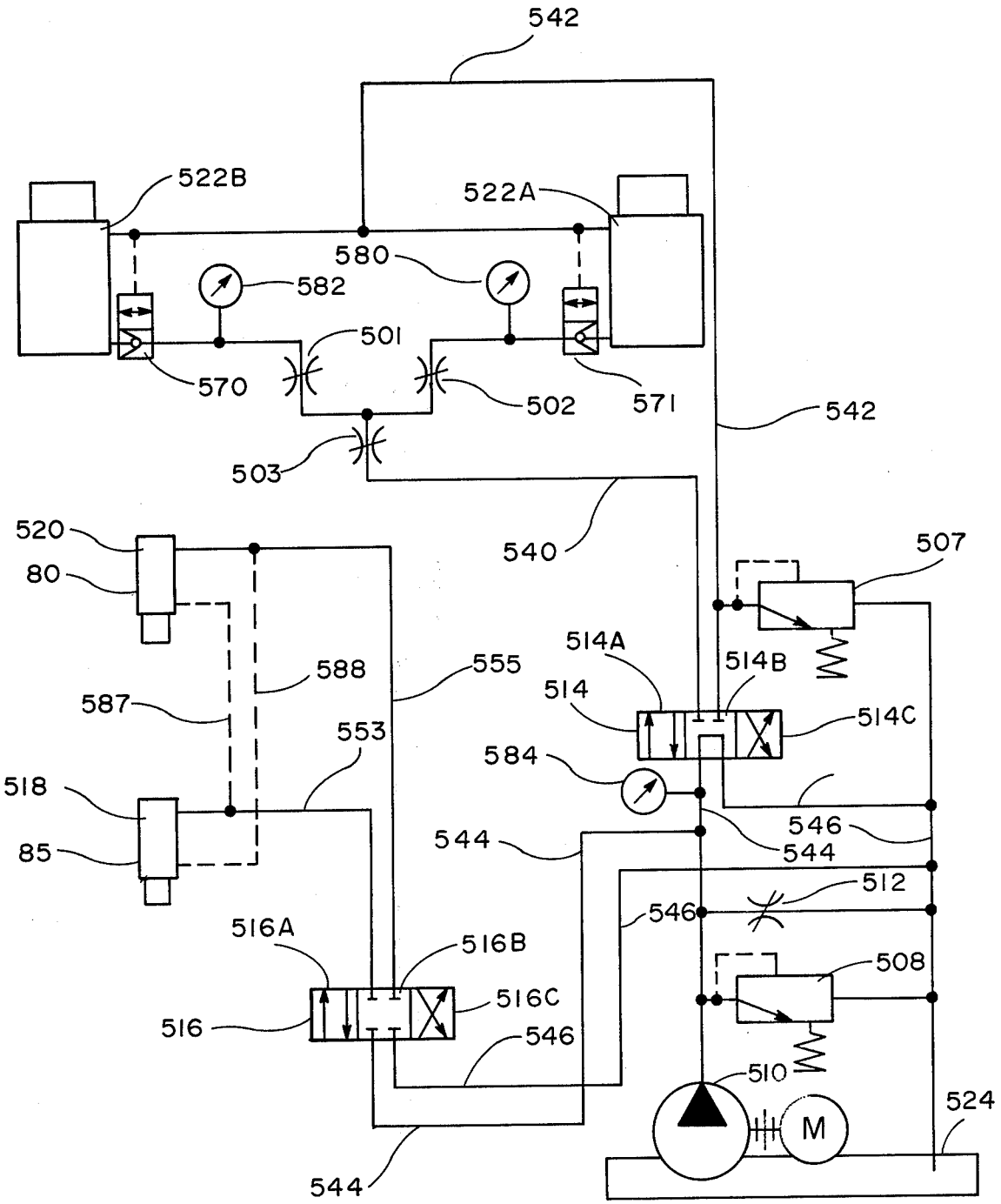
FIG. 5 is a schematic diagram of the hydraulic system of the preferred embodiment.

Referring now to FIG. 5, there is shown a schematic diagram of an hydraulic system in accordance with the preferred embodiment. Initially, main control valve 514 and seating ram valve 516 are in the positions shown. Dump valve 512 is initially in the full open position and the oil being pumped by pump 510 returns to reservoir 524.

To activate the system to lift a load, main control valve 514 is put in the straight through position, i.e. valve segment **514*a* couples line 540 to line 544 and line 542 is coupled to line 546. Seating ram valve 516 is then put in the crossover position, i.e. valve portion 516*c* is used to couple line 544 to line 555 and to couple line 546 to line 553. Next, dump valve 512 is closed. Valve 512** is closed slowly to avoid any sudden movement of the rams.

As the pressure builds in the hydraulic lines, upper seating ram 80 moves much faster than lifting rams 522A and B. This is because ram 80 has a much smaller cross-sectional area and the piston of ram 80 is much smaller than that of rams 522A and B. Upper seating ram 80 causes the upper chucks to be seated, e.g., such as chucks 67 and 68 in FIG. 1. As dump valve 512 continues to be closed, the pistons of lifting ram assemblies 522A and 522B continue to move and thus lift the load. Ram assemblies 522A and 522B each represent a plurality of lifting rams such that when the pistons of lifting rams 522A and B are fully extended, dump valve 512 is opened and check valves 570 and 571 maintain the pressure within lifting ram assemblies 522A and 522B and thus the load is held. Main control valve 514 is then put into the cross-over position, i.e., lines 540 and 546 are coupled together and lines 542 and 544 are coupled together. Also, seating ram valve 516 is put in the straight through position i.e. lines 553 and 544 are coupled together while lines 555 and 546 are coupled together. Dump valve 512 is again slowly closed activating lower seating ram 85 and seating the lower chucks, such as chucks 20 and 26 shown in FIG. 1, following which the cracking pressure of the check valves 570 and 571 in lifting rams 522A and 522B is exceeded, allowing the forcing of the pistons back down. In addition, the stiffness of the steel strand combined with the downward movement of the pistons of lifting rams 522A and B forces the upper chucks (such as 67 and 68 shown in FIG. 1) out of the chambers and they are held out by the compression springs.

For lowering, the sequence of apparatus will depend on whether the top or bottom chucks are seated and whether the pistons of lifting ram assemblies 522A and 522B are extended or retracted.

Assuming that the pistons are extended and the top chucks are engaged, the load may be lowered by simply changing the direction of fluid flow to lifting rams 522A and 522B by placing main valve 514 on position 514C after opening dump valve 512. Once valve 514 is in position 514C, closing dump valve 512 will cause the pistons of ram assemblies 522A and 522B to be retracted.

If, after the pistons are almost fully retracted, it is desired to further lower the load, the dump valve 512 is opened to stop the movement of the rams. Valve 516 is then moved to position **516*a*. As dump valve 512 is then closed, the bottom chucks are seated by lower seating ram 85 and the pressure is relieved on the upper chucks by relieving the pressure on the upper seating ram 80. Dump valve 512 is then closed again to cause the pistons of lifting rams 522A and 522B** to move down the small remaining distance, typically about one inch, to a position of full retraction. This causes the top chucks to become unseated.

Dump valve 512 is again opened and valve 514 is then shifted to position 514*a*. Dump valve 512 is again closed and the pistons of rams 522A and 522B are extended under no load to within a small distance, i.e. about one inch. At that time dump valve 512 is opened to stop the piston movement. Valve 516 is then shifted to position 516*c* and dump valve 512 is closed. This causes upper seating ram 80 to seat the upper chucks and also causes the pressure to be relieved in lower seating ram 85. Dump valve 512 is then opened and valve 514 is shifted to position 514*c* which brings the rams back down with the load on the upper chucks. This operation is repeated until the desired lowering of the load is accomplished.

Needle valves 501 and 502 are used to control any imbalance between ram assemblies 522A and 522B. Needle valve 503 is used to control the lowering speed of rams 522A and 522B. Pressure relief valves 508 controls the system operating pressure and relief valve 507 limits the return pressure from the rams on line 542. If, because of operator inattention or for some other reason, the system should jam or hang up, valve 508 will ensure that the pressure does not exceed some preselected limit.

An alternative embodiment would use the chuck assembly shown in FIG. 4 wherein a second plate, e.g. plate 300 of FIG. 4, is attached to each of the seating rams and mounted to engage each of the adjacent chucks beneath their upper flanges. In addition, auxiliary pressure lines shown as dotted lines in FIG. 5 would be added to cause one seating ram to withdraw its respective set of chucks as the other set is being seated by the other seating ram. Also, rams 80 and 85 would have to be double acting rams rather than the single acting spring return rams which could otherwise normally be used.

Other variations in the preferred embodiment could be made. For example, a center hole ram could be used instead of clusters of three lifting rams. The preferred embodiment uses three separate rams since if one of more of the rams fail during use they can be replaced without having to cut any strand or abort the lifting operation.

What I claim is:

1. A strand lifting system comprising:

at least one strand for lifting and lowering a selected load;

upper and lower plate means, each plate means defining at least as many openings therethrough in a substantially matching arrangement as there are strands, for passage of one of said strands therethrough each with the upper and lower plate means being aligned with respect to the other to substantially align the openings in each plate means with those in the other;

jack means disposed between said upper and lower plate means for providing a selected separation between them and for maintaining alignment of the plate means openings, one plate means with respect to the other;

chamber means within each opening in the upper and lower plate means defining a tappered hole therethrough and having a strand pass unrestrictedly therethrough;

chuck means disposed adjacent to each chamber means for engaging the strand passing therethrough upon the seating of the chuck means within the chamber means in response to a seating force; and for permitting the unrestricted passage of the strand when the chuck means is disengaged from the chamber means;

bias means coupled to each of said chuck means for biasing said chuck means in the disengaged position from said chamber means; and seating means for providing said applied seating force to the chuck means;

said chuck means each having:

an outwardly projecting flange portion, the top surface being adjacent to the seating means for communication of said seating force thereto;

a nose portion being tapered on its outer surface to substantially match the taper of said chamber means; and a shank portion intermediate said flange and nose portions, said shank portion having substantially uniform thickness over its entire length;

the lower surface of said flange portion sloping inwardly and away from its top surface at a selected angle toward the shank portion;

said chuck means also defining an interior cylindrical hole along its longitudinal axis with the diameter of said hole through the flange and shank portions being greater than that of the nose portion.

2. The strand lifting system as in claim 1 wherein said jack means is hydraulically actuated.

3. The strand lifting system as in claim 1:

said chuck means including a plurality of jaw means each having strand gripping teeth on the interior surface of the nose portion; and wherein said bias comprises a spring coiled about each of said plurality of jaw means for containing same when they are not seated within said chamber means and being disposed between the lower surface of the flange portion of the chuck means and the corresponding chamber means and for causing the nose portions of each jaw means to pivot away from the strand as a result of the combined effect of the sloping lower surface of the flange portion, and the larger internal diameter of the flange and shank portions.

4. The strand lifting system as in claim 1 wherein said bias means includes an extraction means for disengaging said chuck means from the chamber means and for supporting said chuck means in the disengaged position.

5. The strand lifting system as in claim 2 wherein said seating means includes an upper and a lower hydraulic ram means for seating said chuck means into their corresponding chamber means in the upper and lower plate means, respectively, in response to a hydraulic control pressure.

6. The strand lifting system as in claim 5 wherein said upper and lower hydraulic ram means are mounted on the upper and lower plate means, respectively.

* * * * *